US005183409A

United States Patent [19]

Clever et al.

[11] Patent Number: 5,183,409

[45] Date of Patent: Feb. 2, 1993

[54] HERMAPHRODITIC MULTIPLE CONTACT CONNECTOR

[76] Inventors: Eric Clever, 29 Estaugh Ave., Haddonfield, N.J. 08033; Ray Lyons, 989 Highland Ave., Parkland, Pa. 19047

[21] Appl. No.: 685,422

[22] Filed: Apr. 15, 1991

[51] Int. Cl.[5] ..... H01R 13/28

[52] U.S. Cl. ..... 439/291; 439/284

[58] Field of Search ..... 439/284–294, 439/295, 262, 660

[56] References Cited

U.S. PATENT DOCUMENTS

| | | | |
|---|---|---|---|
| Re. 23,547 | 9/1952 | Fox . | |
| 2,577,508 | 12/1951 | Biggert, Jr. . | |
| 2,745,076 | 5/1956 | Kolstad . | |
| 2,832,943 | 4/1958 | Cutler . | |
| 3,011,143 | 11/1961 | Dean | 439/291 |
| 3,123,422 | 3/1964 | Mock | 439/292 |
| 3,224,222 | 12/1965 | Palmer, Sr. . | |
| 3,259,869 | 7/1966 | Batcheller . | |
| 3,638,164 | 1/1972 | Glance | 439/284 |
| 3,800,556 | 4/1974 | Duerksen | 403/364 |
| 4,280,339 | 7/1981 | Stuemky | 403/341 |

*Primary Examiner*—Neil Abrams
*Attorney, Agent, or Firm*—Paul Maleson

[57] ABSTRACT

An hermaphroditic connection comprising two identical mating connectors. Each connector has at least one axially extending finger and at least one space. The spaces and fingers are sized and configured so that a finger of one connector is firmly insertable into the space of the other connector. For electrical connections, each connector may be provided with one or more conductors. The conductors may be simple conductors or co-axial conductors. Each conductor is split equally longitudinally along the length of the finger through which is passes. When a connector is mated with another connector to make a connection with a wiping insertion action, the split conductors are mated along a relatively large interface area. Electrical connections having very good resistance and impedance characteristics and very good connection and disconnection physical characteristics are attained.

17 Claims, 9 Drawing Sheets

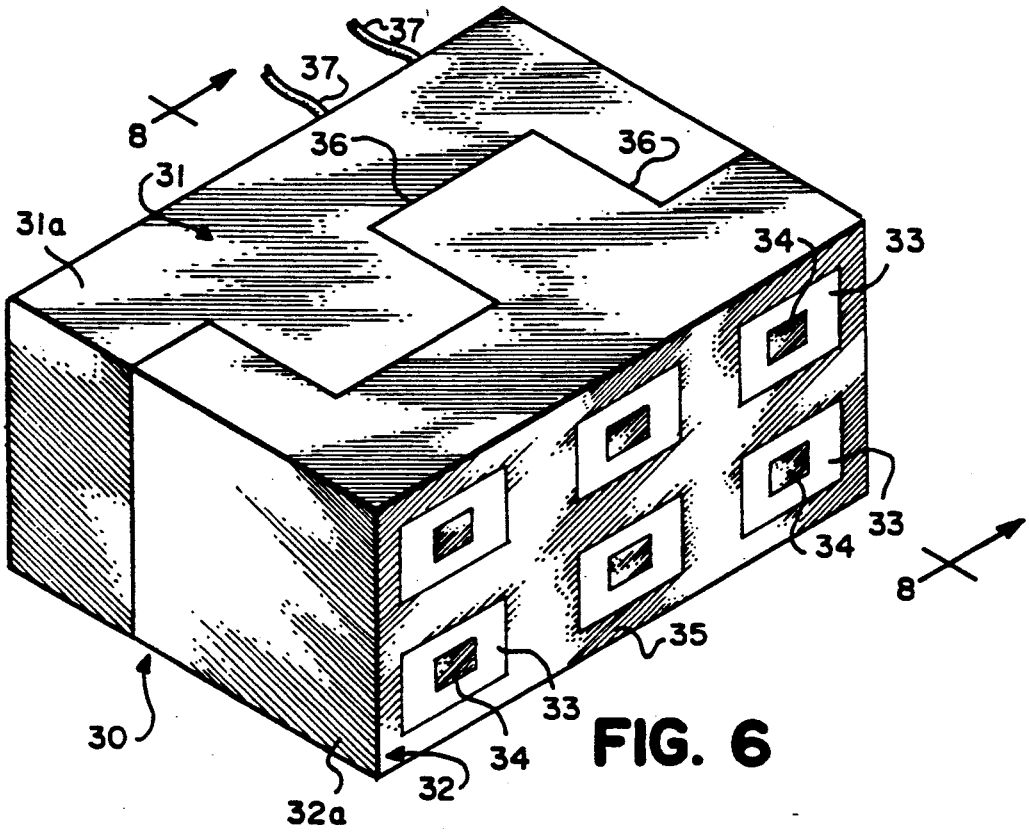
FIG. 6
FIG. 7
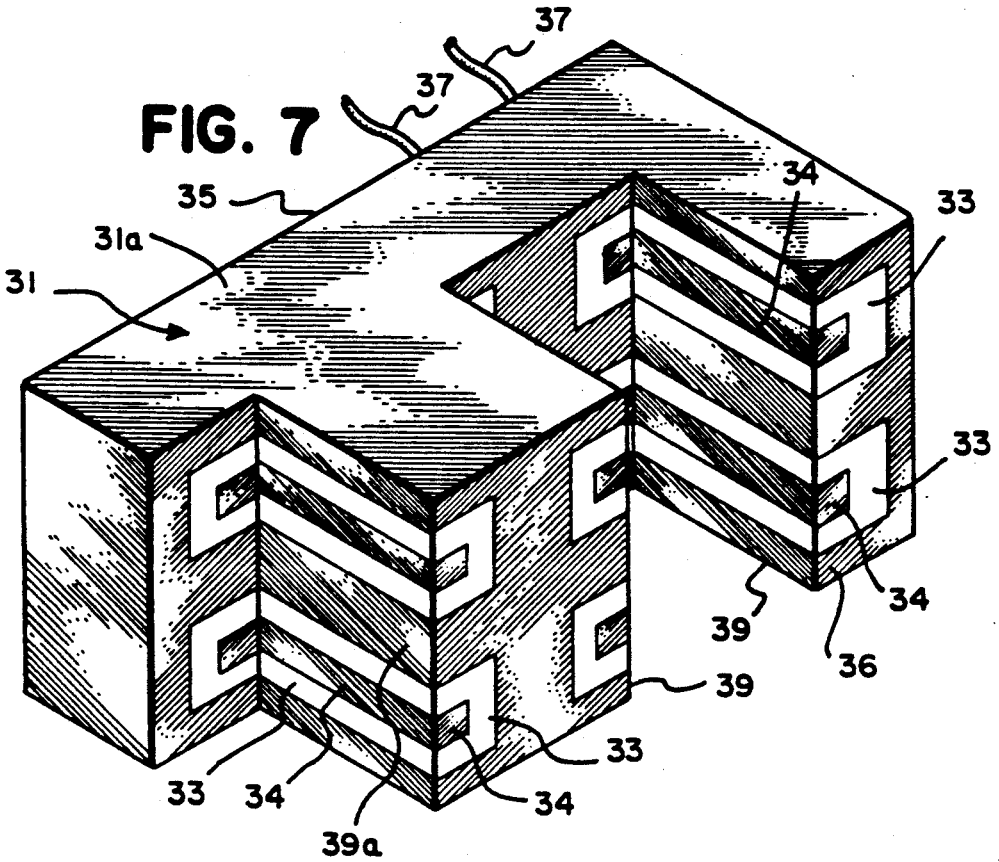

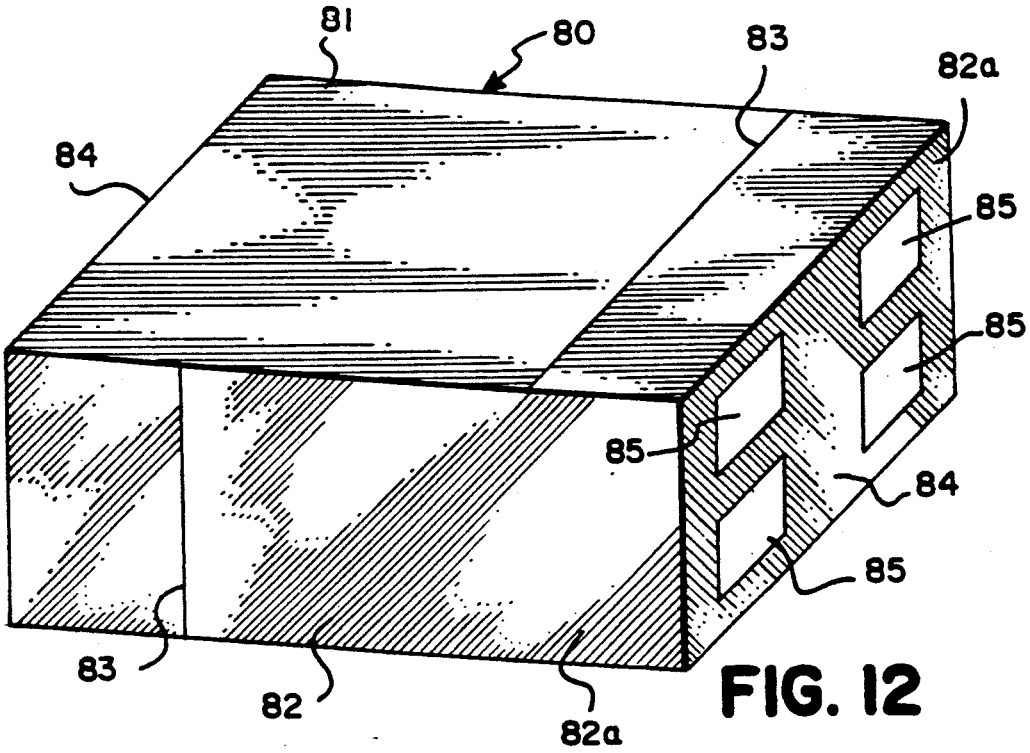
FIG. 12
FIG. 13
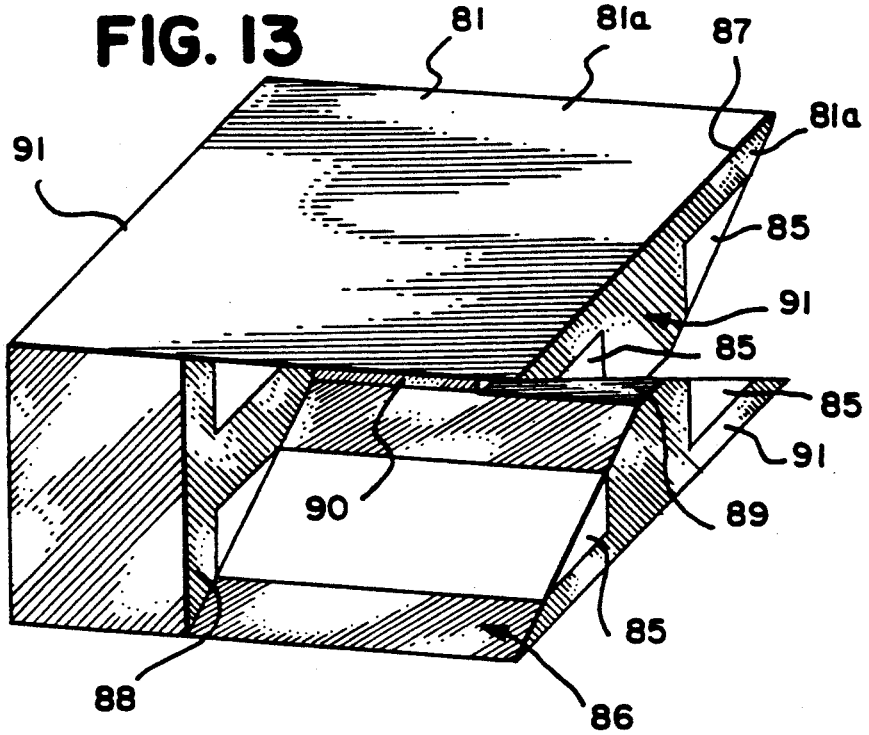

HERMAPHRODITIC MULTIPLE CONTACT CONNECTOR

BACKGROUND OF THE INVENTION

1. Field of the Invention

This invention relates to connectors. More particularly, it relates to hermaphroditic connectors. It has specific preferred application in the electronics field. Connectors of the invention have low or controlled impedance and low or zero insertion force. It has applicability to co-axial and multi-axial connectors and to mass connectors and backplane connectors. While the electronics application is the specific and preferred field, there is possible application for some of the principles of this invention in mechanical connectors or various kinds and field of use.

2. Prior Art

This is a crowded art and there are many U.S. patents, referred to by number below, known to the inventor which have some pertinence. U.S. Pat. No. 3,414,865 discloses an electrical connector system with a mating portion longitudinally split so that identical fingers are offset. The fingers flex and are forced in a longitudinal direction for mating. U.S. Pat. No. 3,115,379 discloses identical mating pieces mutually insertable for electrical connection. The contact elements when engaged are slightly spread apart and are in resilient contact.

U.S. Pat. No. 2,745,076 is an electrical connector with a pair of connectors to connect with an identical unit. Fingers form an outer circle coextensive with a tubular wall. U.S. Pat. No. Re. 23,547 discloses a quick detachable connector and has fingers insertable into recess areas. U.S. Pat. No. 3,259,869 is an electrical connector with a frictional yielding displacement fit of generally identical mating connecting fingers.

Mechanical connectors include U.S. Pat. No. 4,280,339, which discloses a torque transfer device for flexible shaft couplings. Each staff has an extended portion with forked ends defining teeth. The teeth are inserted orthoganally to each other. U.S. Pat. No. 3,800,556 discloses a power shaft coupling including a coupling mechanism having elongate square bars defining extensions. These extensions may be mutually inserted in orthogonal positional relationship. U.S. Pat. No. 2,577,508 is a universal coupling with bifurcated tongues that mate.

U.S. Pat. No. 2,832,943 is a detachable coupling in which the male and female members are not identical but do have an orthogonal insert relationship. U.S. Pat. No. 3,224,222 is a universal joint with yoke members including cross-pintles for connecting the yoke members together.

Other presently known U.S. Patents having interest are: U.S. Pat. Nos. 3,516,043; 3,070,769; 2,690,542; 3,011,143; 4,199,208; 3,634,811; 2,996,026; 3,070,769; 2,475,046; 2,470,282; 1,865,300; 2,577,508; 607,607; 3,552,145; 1,171,380; 2,740,271; 4,172,369; 2,460,231; 534,732, and 2,389,115.

It is believed that the present invention is patentably distinct from the teachings of any of the above-cited Patents.

SUMMARY OF THE INVENTION

The present invention comprises a family of connectors. Some embodiments may appear different from each other but they share common principles. Many of them are inherently monolithic with multiple coaxial connections or useful for ultra high performance backplanes in the electronic arts. Some embodiments are self-aligning and are useful as optical cable connectors. All the monolithic embodiments are useful as right angle pc-solderable connectors.

A particular point of common principle in this invention is that all the connector embodiments are hermaphroditic. That is, at any given point of junction or connection, it is not required to specify which connector shall be male and which female. Each connector of a given type is capable of mating with another connector of that type. This provides a very valuable advantage in assembly, in flexibility of manipulation, and in material supply. In addition, the particular characteristics of the present hermaphroditic connector provide important electronic advantages. For instance, changes in impedance through the connector may be eliminated or reduced, thus eliminating or reducing reflections. Impedance through the connector may be controlled. Good electrical contact is made. There is a wiping action during insertion which is advantageous. The connection is firm and reliable and subject to precise control. Connection and disconnection may be made without undue force.

BRIEF DESCRIPTION OF THE DRAWINGS

FIG. 6 is a perspective view of another embodiment of the connection.

FIG. 7 is a perspective view of one of the connectors in the embodiment of FIG. 6.

FIG. 12 is a perspective view of another embodiment of the connection.

FIG. 13 is a perspective view of one of the connectors of the embodiment of FIG. 12.

DESCRIPTION OF THE PREFERRED EMBODIMENTS

Figure 1:
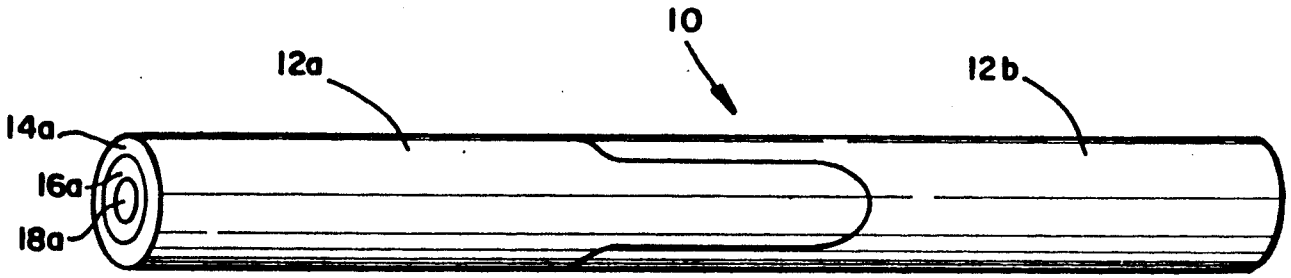
FIG. 1 is a perspective view of one embodiment of a coaxial connector with the connecting elements mated in place.

The embodiment shown in FIGS. 1-5 is illustrative of a co-axial electronic connector. The particular example shown in these drawings is of a connector suitable for a co-axial circuit having a single inner conductor. FIG. 1 shows a joined pair of connectors making a connection generally designated 10. It comprises a first connector 12*a* and a second connector 12*b*. These two connectors are identical to each other. The description applied to the elements of one connector may equally as well be applied to the elements of the other connector and the same reference numerals are used in connection with each of the two connectors. Description may be made as to one of the connectors, it being understood that the description applies to the other as well. In this present patent, the term "connector" sometimes refers to a joined connection including a pair of individual connectors and sometimes the term refers to one of the connectors, whether joined to another one or not. Sometimes the term "connection" or "paired connectors" or "joined connectors" may be used to refer to a joined and inter-connected pair.

The outermost portion or shell of a connector is conductor 14*b* on one connector and 14*a* on the other connector. This may constitute or comprise a shielding member or it may serve as a conductor or as a ground. It, as well as other conducting elements of the device, may be made of any known electrically conducting material, such as copper for example, or copper clad steel, and the invention is not limited to any specific conducting material.

The next inward concentric layer is insulation 16*b* on one connector and 16*a* on the other connector. This may be any known insulation suitable for the particular environment, such as Teflon, (polytetraflouroethylene) polyethylene, PVC, synthetic rubber, or an air gap for example. The invention is not limited to any specific insulating material. The central element of the connector 12*a* is a second conductor, which may here also be termed an inner or central or core conductor 18*a*. In wave guide applications, it can be a hollow tube of conducting material. On connector 12*b*, the core conductor is 18*b*.

Each connector of the pair is provided with a pair of longitudinally extending fingers. For ease of reference, the pair of fingers on one connector is shown and is designated as vertical and the pair of fingers on the second or other connector is shown and designated as vertical. Thus, as best initially understood from FIG. 2, one connector 12*b* has a pair of identical vertical fingers 22*b*. The other connector 12*a* has a pair of identical horizontal fingers 22*a*. Each finger on each connector is identical to all other fingers on both connectors 12*a* and 12*b*. The connectors 12*a* and 12*b* are identical and the only difference in the drawings is that they are rotationally displaced from each other by 90°, without any difference in structure.

Figure 2:
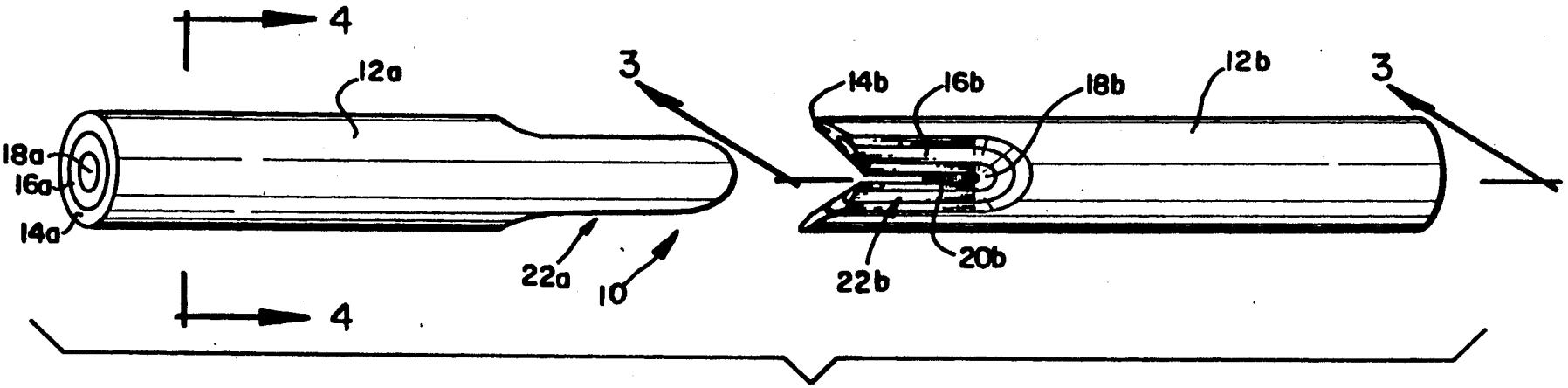
FIG. 2 is an exploded view of the connector of FIG. 1 with the connecting elements detached.
Figure 3:
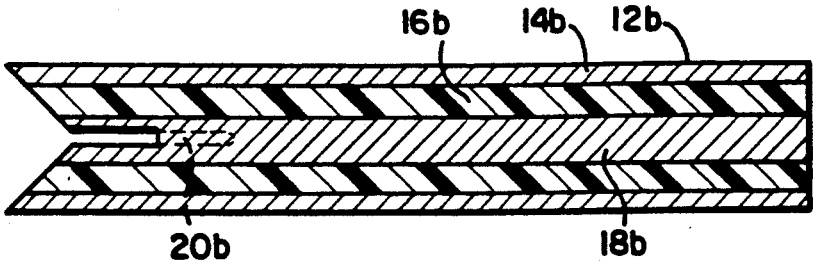
FIG. 3 is a longitudinal cross-sectional view of one connector taken along line 3—3 of FIG. 2.
Figure 4:
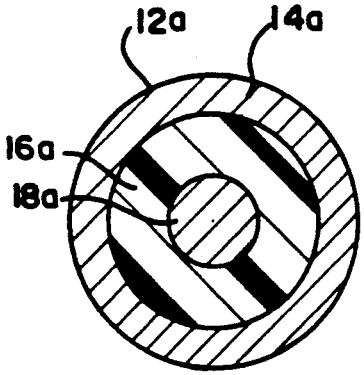
FIG. 4 is a transverse cross-sectional view of one connector taken along line 4—4 of FIG. 2.
Figure 5:
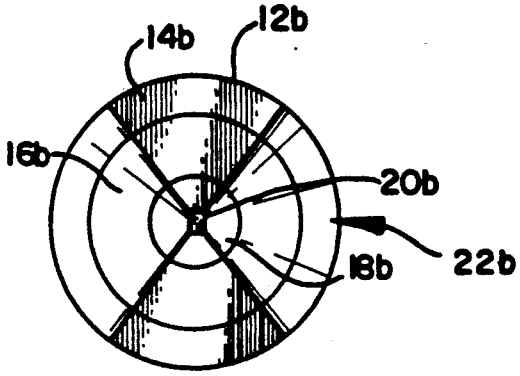
FIG. 5 is an end view of one connector in a detached state.

The configuration of finger pairs 22*a* and 22*b* are best shown in FIG. 5, which is an end view of an unattached connector, in another aspect, in FIG. 3, which is a longitudinal cross-sectional view through a connector along line 3—3 of FIG. 2, and in perspective, in FIG. 2, which shows a separated or exploded pair of connectors 12*a* and 12*b*. In FIG. 2, the connectors 12*a* and 12*b* are shown aligned ready to be joined and inter-connected by a longitudinal motion of the two connectors toward each other.

The fingers on each connector are wedge shaped extensions of the main body of the connector, with the point of the wedge at the middle, and the back of the wedge extending as part of the circumference of the connector. This is best appreciated from FIG. 5. In addition, the leading surface of each finger is sloped rearwardly from the outermost portion to the central portion, as best shown in FIG. 3. The slope or angle of that portion of the connector exposed between the fingers, as best shown in FIG. 2 surrounding core conductor 18*b* forming a shoulder, matches the slope or angle of the leading surface of the finger. Thus, when the two connectors 12*a* and 12*b* are fully mated, the leading or front surface of each finger on each connector fits against the shoulder between the fingers on the other connector.

As best shown in FIGS. 2 and 3, the space between the innermost portions of a pair of fingers on a connector defines a longitudinal slot. Also, however, as best shown in the same Figures, the slot does not continue back the full length of the fingers. Instead, the rearward separation between a pair of fingers on one connector is a web 20*b*. This web 20*b* may and preferably is an extension of part of the central or core conductor 18*b*. As best shown in FIG. 5, it is preferably shaped into a rectangular shape. The identical webs 20*b* on each of the mated connectors 12*a* and 12*b* serve as stops and limit the mutual travel of the connector pair.

Of course, each connector 12*a* and 12*b* is electrically connected at its rearward end to an appropriate cable in any known manner, not a part of this invention. As example only, a typical electronic connector made in accord with this invention might have an outside diameter of 0.250", a web thickness of 0.010", a slot width of 0.012", an open slot length of 0.291", a full finger length of 0.563", an overall length of 1.126", a rearward slope of the finger leading surface of 45° to the horizontal, a circumferential angle of 90° from longitudinal face to face of a finger and 90° from the longitudinal face of one finger to the face of the opposing finger on the same connector. As another example, a typical electronic connector made in accord with this invention might have an outside diameter of 0.085", a web thickness of 0.004", a slot width of 0.005", an open slot length of 0.106", a full finger length of 0.191", an overall length of 1.382", a rearward slope of the finger leading surface of 45° to the horizontal, a circumferential angle of 90° from longitudinal face to face of a finger and 90° from the longitudinal face of one finger to the face of the opposing finger on the same connector. The preferred angle of all inclined faces is 90° from the opposing face, which makes for maximum ease of assembly. The preferred radial configuration is 90° of arc for each finger. The edge of the tip or end of each finger is configured to form a radial arc, as viewed either from the side or the end.

The two connectors have a mild interference fit. There is enough mutual give, due to flexing away from the slot, so that the connectors can be engaged by axially, longitudinally moving them relatively toward each other with a chosen amount of force.

In use, in order to accommodate dimensional variations in the length of the lines to be connected, the connectors can be slightly backed off from full engagement, while still maintaining full electrical contact.

An important characteristic is that there is a continuity of cross-section of the connectors and their join surfaces. Electrically, this is useful in avoiding both mechanical and electrical discontinuities. Electronic reflections from the connection are minimized. In addition, there is a long wiping engagement face between the connectors so that there is a greater likelihood of a clean connection. A wiping action is in itself common to other connectors. In this present invention, there is also a physical pushing action which tends to actually push dirt out of the connector.

The contacting areas of the mating surfaces are four times that of the corresponding cross-sectional area of the cable. Thus, the resistance through the connector can be lower. The impedance in the connector does not have to be higher than the impedance in the cable and therefore reflection is reduced or eliminated. The resistance across the actual mating faces is lower, or not higher, than the resistance along the same longitudinal length of connector without a mating face. The large contact area is significant, especially at higher frequencies, because of the skin effect; that is, the tendency of the current to travel near the surface of the conductor. This ability to control resistance and impedance makes it reasonable to design so that the overall impedance through the joined connectors as a unit is the same as the same length of cable, with electrical advantages as have been explained above.

Another important aspect is that the external dimension need be no greater than that of the cable itself. Thus, it is possible to have a bundled array of co-axial cables, each mating with another, wherein the overall transverse configuration of the connections is not greater than the sum of the diameters of the cables themselves. Conventional coax connectors have relatively bulky fittings and flanges. The present device does not require such radial extensions because it is self-aligning.

The web **20*b*** is important for several reasons. It provides structural strength. It prevents the fingers from tending to spring outward and lose the firmness of their contact. When the connectors are joined, the webs abut or nearly abut each other and act as stops. Without the webs as stops, if excessive joining axial force is exerted, the fingers may tend to ride over the shoulders or inclines on the other mating connector and spread apart. The presence of the webs as stops prevent such riding up.

The number of concentric layers can be varied. For example, the device can be tri-axial. The device may be made with three or more equal fingers instead of the preferred two fingers as shown. The cross-section of each finger may be square, triangular, or hexagonal for example. The device can even be made with a single finger on each individual connector, though this is not preferred. If the radial segments are of unequal arcs, the connector is thus polarized. This is not preferred, for manufacturing reasons, and instead it is preferred to achieve polarization, if needed, by some separate means, as a key and slot, not part of this invention.

Different amounts of separation resistance or locking can be provided. A small hump may be provided on the tip of a finger, mating with a matching depression at the base of the finger on the mating connector. Such humps or detents are also hermaphroditic. A detent or hump rounded at the rear end makes the connectors more easily separable; a detent or hump made square or rectilinear at its back face tends to lock the connectors together. The amount of squaring or rounding is a matter of choice and design depending on the degree of locking required. In addition, the amount of interference fit of the fingers also influences the force of insertion and removal.

In manufacture, standard milling techniques are adapted to this construction. If the starting material is semi-rigid coax, the insulation is usually Teflon, and if the slot is milled from one side at a time, there may be a tendency to extrude or force the Teflon out of the other side. Therefore, it is preferable to use a pair of opposing cutters so that the Teflon is confined while being cut. The cutters should be 90 degree cutters with a flatted tip. The diameter of the flat should be equal to the web thickness and the cutters should be positioned that distance apart for a square web cross section. The leading or front surfaces are formed by passing a 90 degree cutter in a 180 degree arc centered on a point on the midline of the connector and in the same plane as the side slots.

A field of application of this invention is in fiber optics because of the rotational and axial self-aligning properties of this device. A field of application is in general mechanical connection. There is a strong connection with a minimum of mechanical discontinuity and little or no stress risers. In torque, the force transmitting faces have large areas, which is desirable. There is a field of application in the toy industry in the provision of connectors for construction sets.

The embodiment described above is particularly apt for the connection of a single co-axial cable. The broad principle of this invention can be extended to connectors that superficially do not look like the embodiment described above. These other connectors are particularly apt for multiple connections; arrays of co-axial or other connectors.

There are several principles or concepts that the entire class of connectors of this invention have in common. Connections between two conductors can be made by one conductor wiping past the other while it is held in contact with it. Another applicable concept is that both halves of a pair of connectors can be initially made as one unit. The unit can then be cut into two pieces during the manufacturing process so that the necessary precision, axes alignment and good contact can all be assured when the two pieces become two mateable connectors.

In practice, it is not actually always necessary to start with a single piece or block and cut it into two pieces. This concept is advanced primarily to indicate the geometrical relationships of the two connectors. Other known manufacturing techniques may be used.

In addition to the embodiment described above, the additional embodiments may be described or referred to as an "F cut" or "comb cut", on one hand or as an "X cut" on the other hand.

Figure 8:
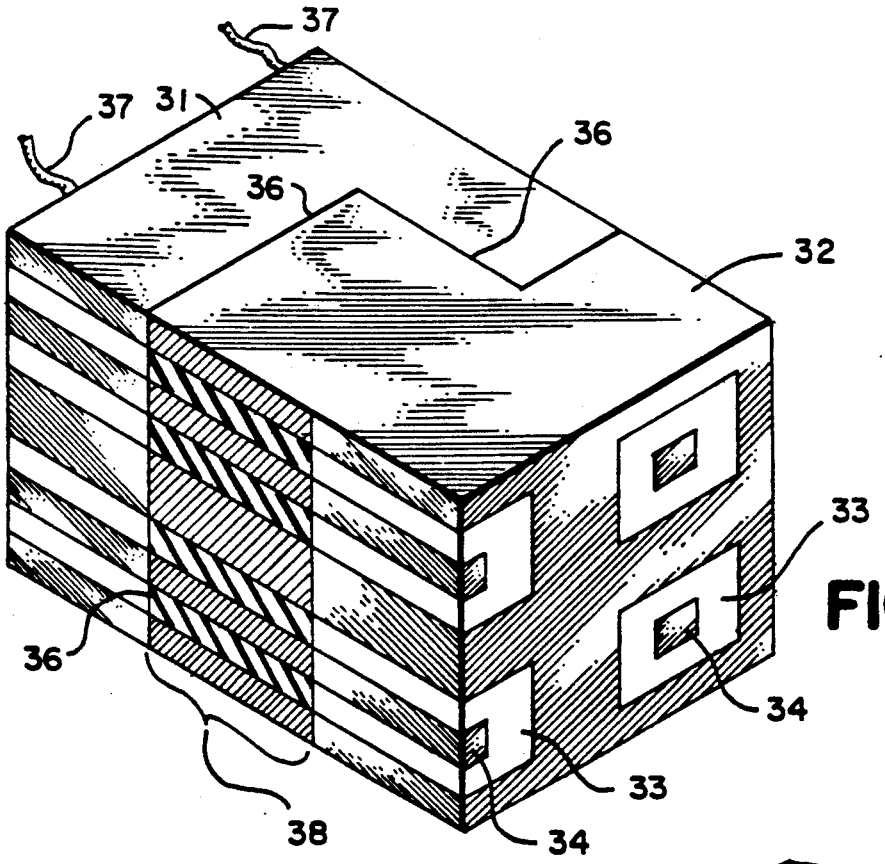
FIG. 8 is a cross-sectional view along line 8—8 of FIG. 6.
Figure 9:
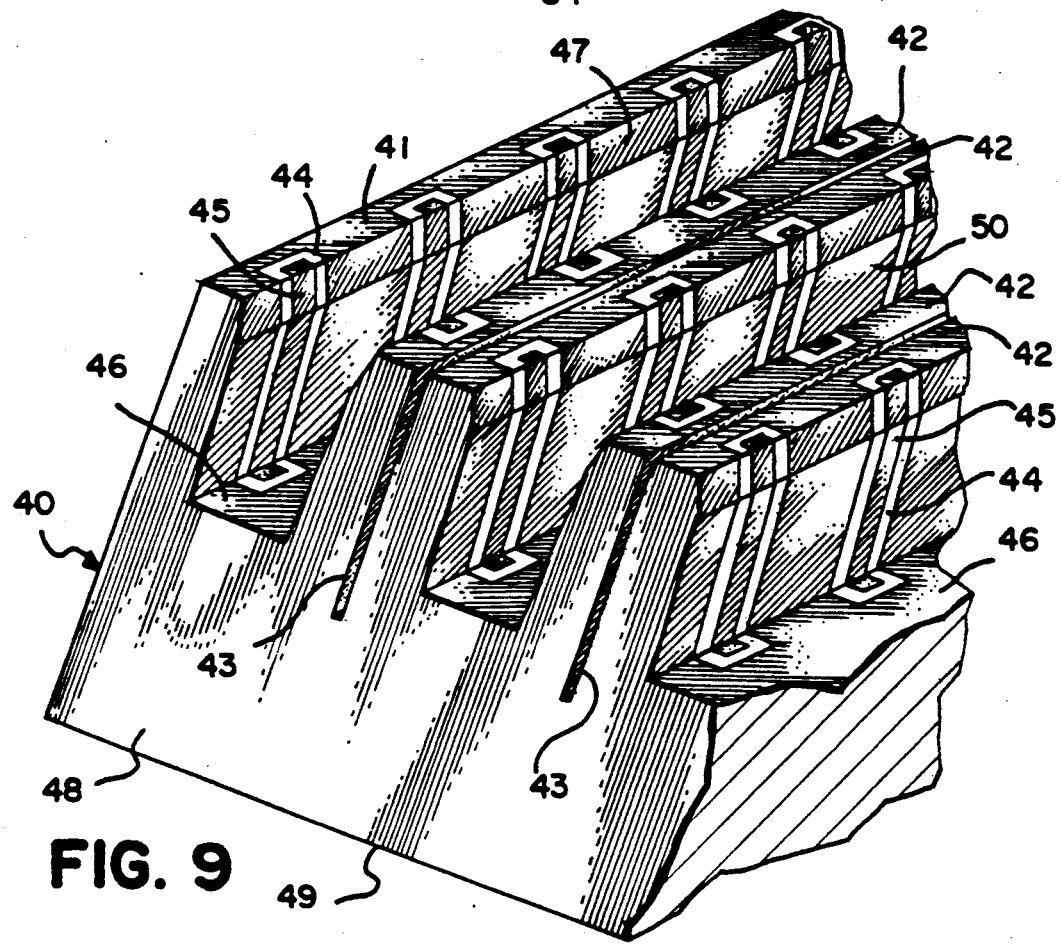
FIG. 9 is a fragmented perspective view of a variation of a connector of the embodiment of FIG. 6.

Connectors of the F cut type are illustrated in FIGS. 6–9. FIGS. 6–8 disclose a simplified, stylized showing for ease of indicating the operative principles. FIG. 9 illustrates a fragment of one connector in an F cut connection in which there is a somewhat more detailed showing of the engineering construction.

FIG. 6 is a perspective view of a connection of the F cut type comprising the two individual connectors shown mated. The connection is generally designated 30. It comprises a first connector 31 and a second connector 32. It is important to note that each of the connectors 31 and 32 are identical to each other. The two connectors mate with each other along the interface line 36. As shown, this line generally suggests the letter F, leading to the descriptive name. As shown, the two connectors mate firmly and completely.

Each connector has a wiring face 35 on the surface away from the mating surface. This wiring face 35 is best shown in connection with connector 32. In this showing, the cables, leads, or wires leading to the wiring face are omitted for illustrative purposes. Representative showings of such cables 37 are however shown in connection with the mated connector 31.

In the illustrated example, there are six co-axial conductors. They are arranged in an orderly array of two rows of three each. The main body or block of the connector 32 is of a conductive metal. It thus is the equivalent or can be described as the shell or outer conductor or shield as was described in connection with the embodiments of FIGS. 1-5. Shell 31*a* comprises part of connector 31.

An insulating layer or ring or encirclement 33 is provided for each of the six illustrated conductors. The inner core or conductor 34 is provided inside each of the insulating layers 33. The six co-ax conductors are identical and some duplicate reference numerals are omitted for ease of presentation.

FIG. 7 is a perspective view of connector 31 of FIG. 6. This figure shows how the insulation layers 33 and inner conductor cores 34 progress through the body of the connector 31. The inwardly projecting parts of the connector 31 are fingers 39. Of course, the corresponding mating connector 32, not shown in FIG. 7, is identical. It is seen that the insulating layers 33 and the conducting cores 34 proceed axially from the wiring face 35 longitudinally through the fingers 39, terminating at the interface 36. The insulation layer and the conducting core are exposed along the sides 39*a* of fingers 39.

FIG. 8 is a cross-section view, in perspective, taken along line 8—8 of FIG. 6. This view, which cuts through the center of two conductors, shows the long contact area 38 produced by the connector of this invention.

While the showings of FIGS. 6-8 are apt for designation as an F connector because the shape, it is understood that the number of fingers 39 may be increased. In FIGS. 6-8 there is shown only a single end finger 39 and a single interior finger having conductors on both sides thereof, also designated 39. When the invention is embodied in a structure having a greater number of fingers, the descriptive term comb connector becomes more apt.

FIG. 9 shows a perspective partially fragmented view of one connector generally designated 40 of a comb type connection. The connector illustrated in FIG. 9, in addition to showing more fingers, shows further structural engineering detail. The connector 40 has a main body or shell 48 which is of electrically conducting material. There is an end finger 41 and a plurality of internal fingers 42. The wiring face 49 is at the bottom in FIG. 9 as oriented, and is hidden from view. The cables, lines or leads running to the wiring face are omitted. Each finger has a chamfer 47 at each side near the tip thereof to aid in smooth insertion. The matching fingers of a mating other connector are inserted so that they extend toward the bottom 46 between the fingers 41 and 42.

Each end finger and interior finger 42 is provided with a plurality of individual conductors in an array. Each conductor comprises an insulating layer, ring or encirclement 44 and a central conducting core 45, as has been described. Each interior finger 42 is split with a slot 43 for purposes as have been described above. That is, the slots contribute to yielding resilience and make it easier to control the removing and inserting force. The side walls 50 of the fingers are preferably provided with a slight angle or draft with the lateral dimension of the space between the fingers slightly decreasing toward the bottom 46.

Figure 10:
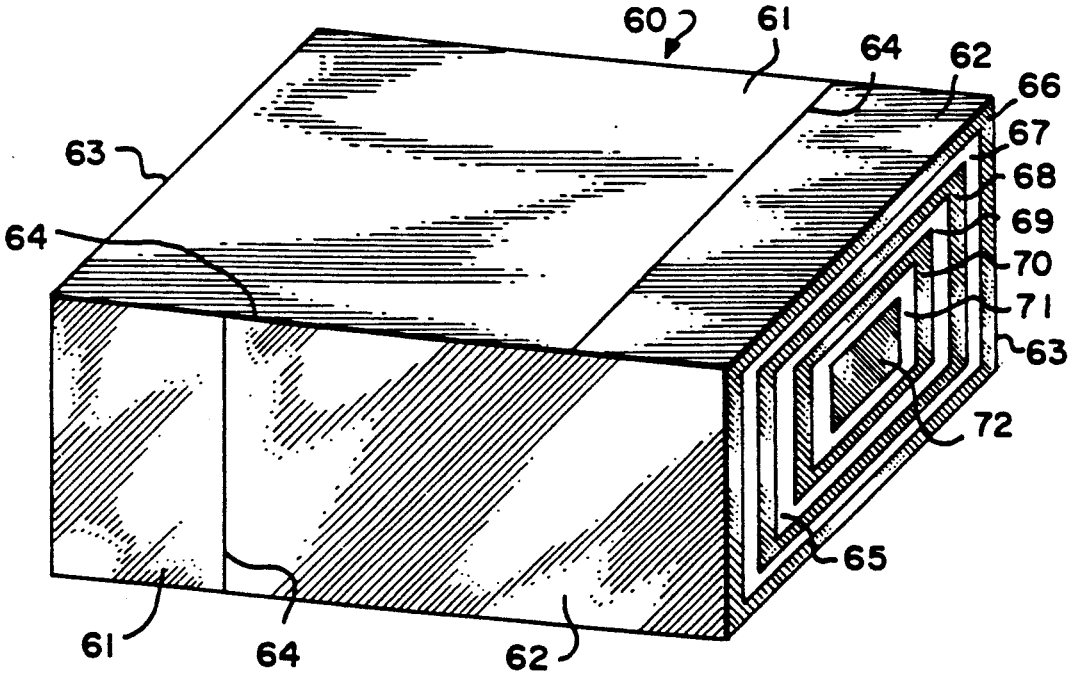
FIG. 10 is a perspective view of another embodiment of the connection.
Figure 11:
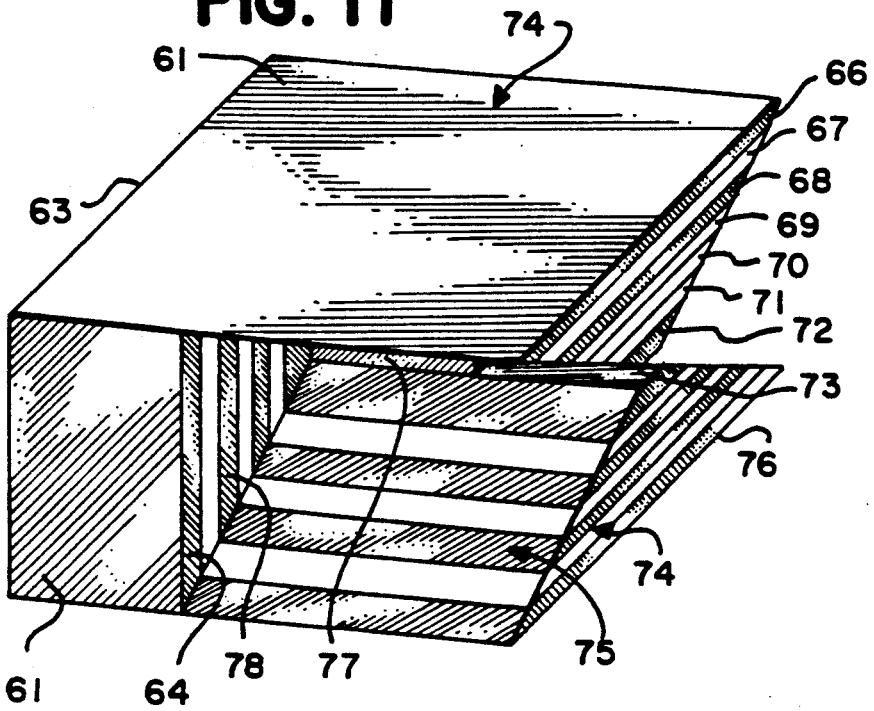
FIG. 11 is a perspective view of one of the connectors of the embodiment of FIG. 10.

The X cut connector may be provided in different forms. One example or embodiment of a form is shown on FIGS. 1-5. Another example or embodiment of a form is shown in FIGS. 10 and 11. This embodiment shows the X cut used for quad-axial contact. One of the important features of contacts made with the X cut is that they are inherently self-aligning.

FIG. 10 shows a complete connection generally designated 60. It comprises the two mated hermaphroditic identical connectors 61 and 62 respectively. These connectors mate along interface line 64. The wiring face 63 of each connector is indicated. Wiring face 63 on connector 61 is hidden at the left side of the figure. Wiring face 63 on connector 62 is shown with its outermost surface cut away so as to expose the inner structure. It is apparent how the connectors and insulators would be brought to continuing connection with an appropriate continuation of the circuit with conventional means. The arrangement of alternating layers concentrically of conductors and insulation is shown at the right hand side of FIG. 10. The outer layer is conductor 66 and comprises the shell or shield of the connector. Moving inwardly there is insulation layer 67, conductor 68, insulation 69, conductor 70, insulation 71, and central conducting core 72. This illustration exemplifies the multiplicity of co-axial conductors.

The remaining structure of each of the connectors in FIG. 10 is best shown in FIG. 11, which is a perspective view of connector 61. It is understood that this is also a perspective view of connector 62. Imagine connector 61 as initially a rectangular block. Part of that structure is cut away so that a view from the right hand side of FIG. 11 shows an X shape. The cut produces two fingers 74. Each finger has sides or faces 75. The perspective view of FIG. 11 somewhat distorts the relationships, but if viewed directly from the right hand end, the X would be symmetrical; that is, the inner surface 76 is a square with two intersecting diagonals. The area between two opposing diagonals is cut away; the area between the other two opposing diagonals is left with its array of alternating insulating and conducting layers. This cut does not go all the way to the other end of the connector. As shown in FIG. 11, toward the left hand end, the cut terminates at a bottom 78.

A slot 73 is provided between the fingers 74. It preferably does not go all the way to the bottom 78, but instead terminates at a web or stop 77. The functions of the web and slot, the fingers, and the wiping surfaces 75 are as have been described above in connection with other embodiments.

The mating exactly identical other connector 62 is positioned so that its inner surface 76 faces the inner surface 76 of connector 61. It is rotated axially through 90°. Then, it can be inserted and mate with the characteristics and advantages as have been described above.

In FIG. 10, the dash diagonal lines 65 indicate the internal positions of the finger faces or sides 75.

The embodiment shown in FIGS. 12 and 13 is a variation of different application of the X cut type connector. It shows as an example four individual conductors on a single contact, rather than being a connector for coaxial conductors.

The pair of mated connectors forms a connection generally designated 80. It comprises a first connector 81 and a second connector 82. The structure, configuration and relationships are as have been described in connection with FIGS. 10 and 11, and in general only those features or aspects that differ from the embodiment of FIGS. 10 and 11 are discussed in connection with the embodiment of FIGS. 12 and 13.

As shown in FIG. 12, the connectors 81 and 82 mate along interface line 83. They each are provided with a wiring face 84. In the embodiment as shown, there are four conductors 85 arranged in a rectangular array. A specific difference from the embodiment of FIGS. 10 and 11 is that in the embodiment of FIGS. 12 and 13, the shell or main body of each connector, that is, shell 82*a* as part of connector 82 and shell 81*a* as part of connector 81, are made of insulating material rather than being electrically conductive. As best shown in FIG. 13, the fingers 91 are separated with a slot 89. The slot 89 terminates at a web or stop 90. The cut-away portions which form the X configuration terminate at bottom 88.

The connector 81 as shown in FIG. 13 can be mated with an identical connector 82, which is positioned facing an interface 87 and is rotated axially 90° to permit mutual insertion.

Structural features, operation, and advantages and variations have been described above and are applicable to this embodiment also.

Figure 15:
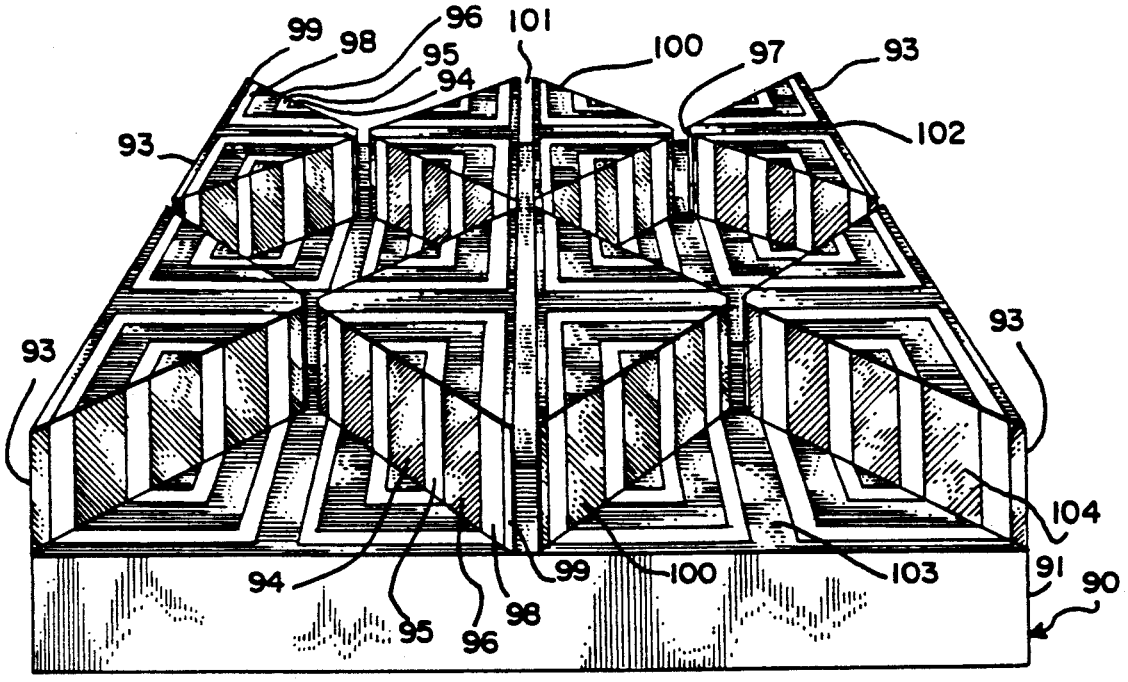
FIG. 15 is a perspective view of a multiple finger tri-axial connector with a relief slot.
Figure 14:
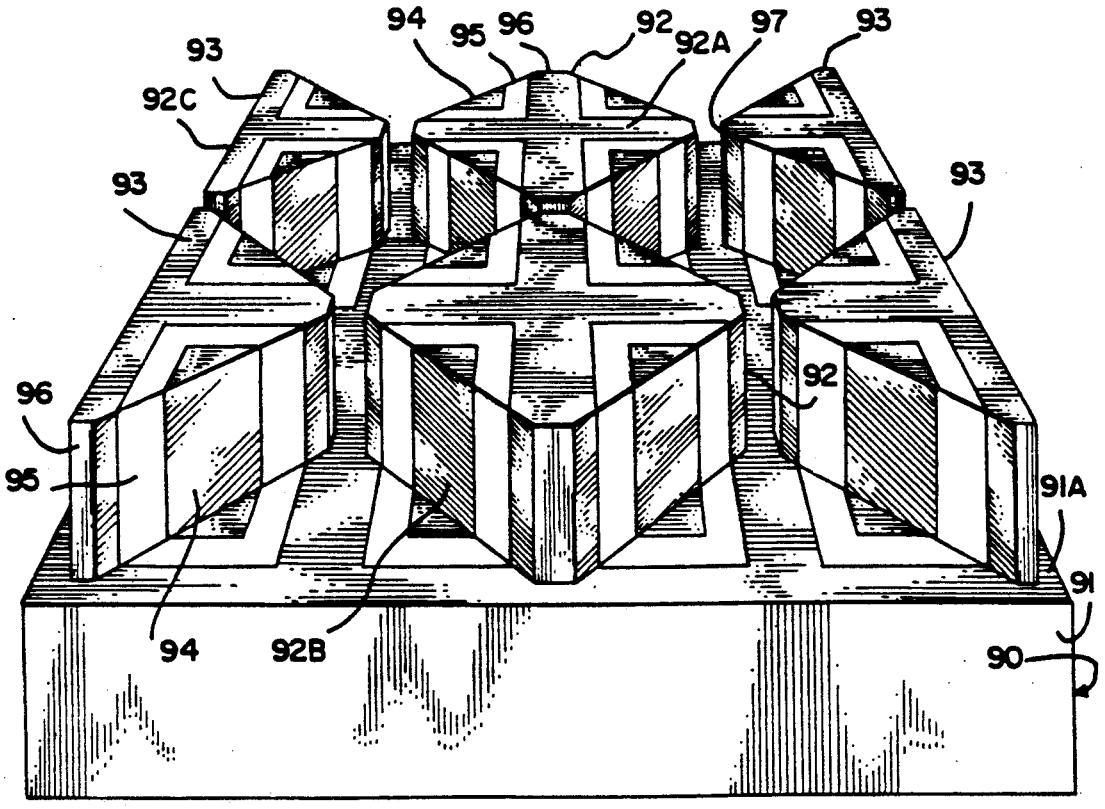
FIG. 14 is a perspective view of a multiple finger co-axial connector.
Figure 16:
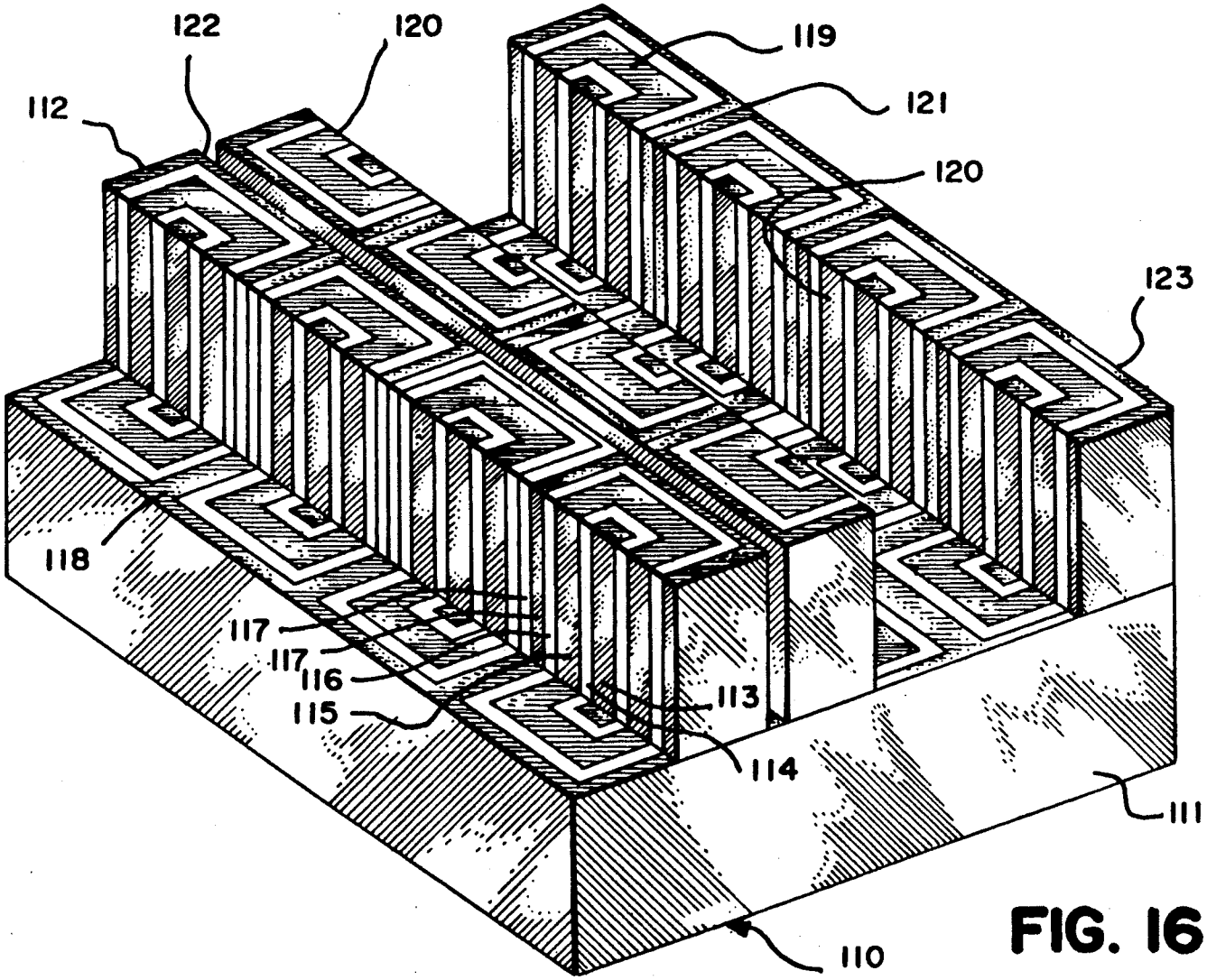
FIG. 16 is a perspective view of another embodiment of a co-axial multiple finger connector.
Figure 17:
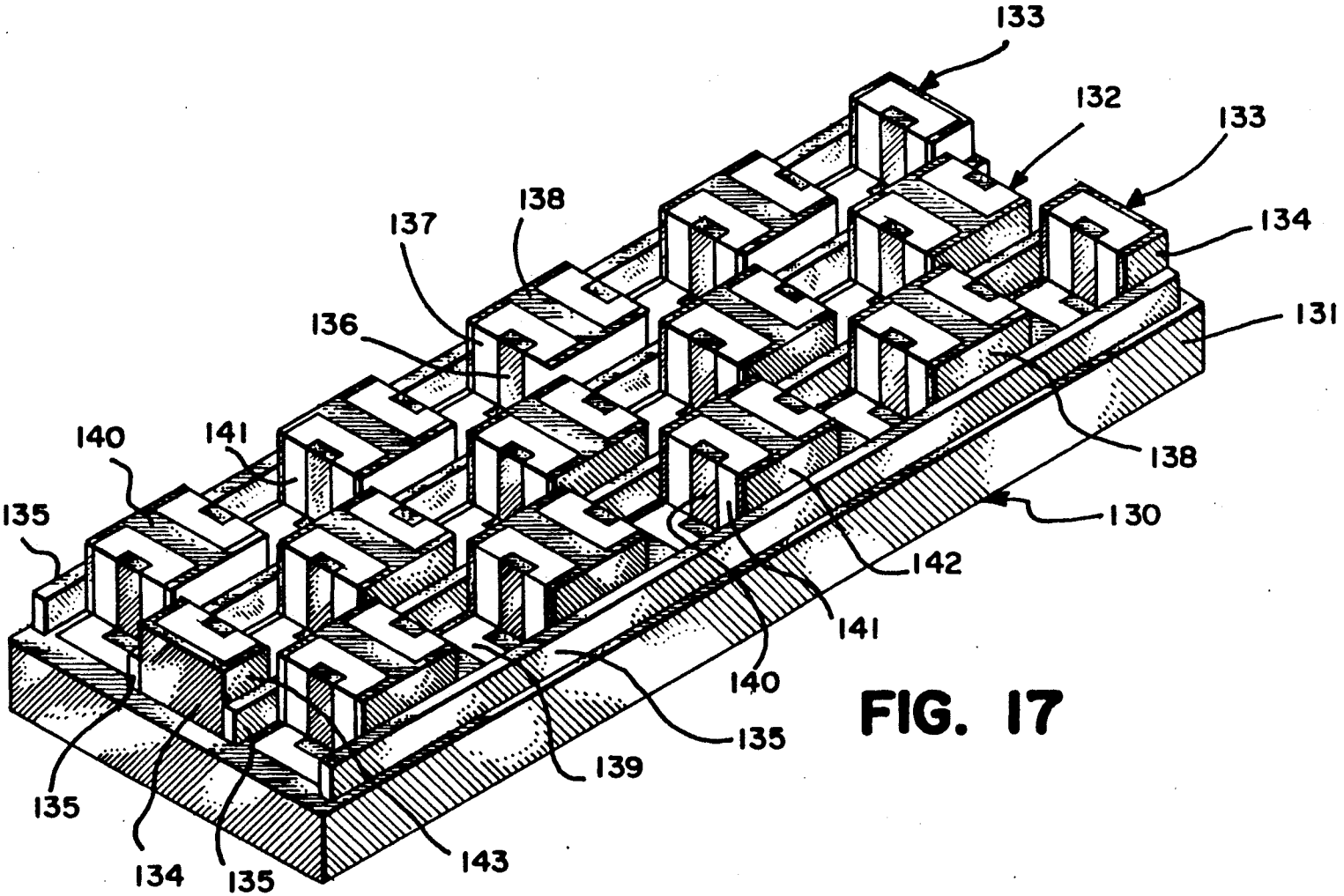
FIG. 17 is a perspective view of a preferred embodiment of a multiple finger connector with an odd number of rows.

FIG. 14 is a perspective view of a multi-finger connector, generally designated 90. This figure, as well as FIGS. 15–17, shows one connector which, when mated with another like connector, forms a complete connection. Since the preferred embodiment of this invention contemplates a mating or mateable pair of two identical hermaphroditic connectors, it is only necessary to show one member of the pair.

In FIG. 14, the connector 90 has a conductive base 91 which becomes a shield or shell. In the representative array illustrated, there are two extended full fingers 92 and four extended half fingers 93. A full finger has a square transverse cross-section. Each finger 92 extending from the base has a top surface 92*a* and four side surfaces 92*b*. Each finger 92 or 93 is isolated from adjacent fingers by a space, gap or slot 97.

Each full fingered 92 includes, on each side 92*b*, an inner conductor or core 94, surrounded by a layer of insulation 95, in turn surrounded and completed by a conductor, shield or shell 96. The conductor 96 is a continuation of the conductive base or shell 91.

The co-axial conductor on each side, as described above, is in actuality only one half of the longitudinal or axial extent of the coax in the finger. The other half of each coax is found in an adjacent side of an adjacent finger in a mating-like connector, not shown as discussed above.

The arrangement of inner conductive core 94, insulation 95, and outer conductor or shield 96 as described above also applies to the half fingers 93, except that these half fingers have been cut along a diagonal so that there are two inward-facing sides 92*b* having conductors and a single outward-facing side 92*c* which is entirely conductive outer shell material. Thus, there are only two half coaxes in the half fingers 93.

It is apparent that an identical other connector may be aligned axially with the longer upstanding axes of the fingers, positioned so that its half fingers are inwardly-facing from the front and back respectively rather from the left and right as shown in FIG. 14, and may be mated with the connector shown by an axial movement. The fingers of one such connector may move into the spaces between the fingers of the other such connector, until the top surface 92*a* of one connector reaches the bottom surface 91*a* of the other connector. The bottom surface 91*a* is the surface of the shell lying between the fingers. It is apparent that, as shown in FIG. 14, there are two ways in which the connectors can be mated to form a full connection. That is, one connector can be rotated 180° so that what would have been a front inwardly-facing half finger 93 becomes a back inwardly-facing half connector 93. Thus, the connection of FIG. 14 comprises mateable or mating connectors which are hermaphroditic and identical, and which form a connection which is not fully polarized. Polarization, if required, would be accomplished by means external to the structure of this specific invention. Elements of FIG. 15 that have the same general description as FIG. 14 are identified with the same reference numerals except as noted. The electrical structure on each side comprises an inner conductive core 94, a surrounding insulation layer 95, a further surrounding second conductive layer 96, a further second insulating layer 98, and an outer conductive layer, shell or shield 99. Each full finger 100 thus comprises on each of its sides, one half of a tri-axial conductor.

The same slot, gap or space 97 is provided between adjacent fingers as has been described in connection with FIG. 14. Each full finger 100 and half finger 93 has a top surface 102. The bottom surface of the shell or base 91 is designated 103. Another difference in FIG. 15 from the embodiment of FIG. 14 is that each full finger 100 is bifurcated along a diagonal with a relief slot 101. A relief slot 101 is primarily an engineering expedient to provide some resilient yield so that a more satisfactory sliding connection and disconnection may be made with mildly interfering hermaphroditic identical like connectors to form a full connection. It is apparent that the relief slot 101 may be omitted in the embodiment of FIG. 15, or, conversely, can be added in the embodiment of FIG. 14. It is further apparent that the embodiments of FIGS. 14 and 15 are not limited to coax or triax conductors, but the principle can be extended to multi-axial conductors.

FIG. 16 shows another embodiment of a F or comb type connector, generally designated 110. It comprises an conductive base or shell 111. It comprises a full finger 112 and an end finger or half finger 123. Each finger has a top surface 119. End finger 123 has a single side surface 120 and full finger 112 has two closed side surfaces 120. In the embodiment shown, full finger 112 has a relief slot 117.

This embodiment illustrates an array or multiplicity of triaxial connectors. A central core conductor 113 is surrounded by insulating layer 114. This in turn is surrounded by a second conductor 115, which in turn is surrounded by a second insulation 116. Finally, the outer conductor, shield, or shell 117 is the outermost layer. As illustrated in FIG. 16, each tri-axial conductor is shown surrounded by its own outer shield conductor 117, so that between two adjacent such tri-axial conductors, there are two adjacent conducting elements.

To avoid cluttering the drawing, not all of the tri-axial conductors are fully identified with reference numerals, but it is apparent that the identical descriptions apply to them.

The full finger 112 has a set of tri-axial conductors facing outwardly on one side surface 120. The end or half finger 123 is provided with a set of tri-axial conductors facing inwardly on its side surface 120. Its outer surface 121 is conductive shield or shell.

Another connector, identical to the one illustrated in FIG. 16, may be mated with the illustrated connector. It is apparent that such a mating connector, in relationship to the illustration, would be upside down, with its end finger 13 toward the lower left. This produces a polarized connection. The insertion and removal can be made axially with respect to the fingers, or can be made by a lateral sliding insertion. The fingers of one connector enter the spaces between the fingers of the other connector until the bottom surface 118 is reached. As is the case with the other illustrated connectors, it is apparent that half of the axial extent (with respect to the fingers) of each tri-axial connector is provided on one finger, and the other half is provided on the finger on the other connector adapted to mate with it. It is also apparent that while there are two modes of insertion and removal, in this embodiment the connection is not as inherently mechanically stable because the connectors can move transversely as well as axially with respect to each other.

FIG. 17 shows a preferred form of a comb or F type connector conceptually developed from the embodiments of FIGS. 9 and 16. It also has a conceptual relationship to the embodiments of FIGS. 14 and 15 for example.

In this preferred form, there are an odd number of rows (a row in the figure running from the lower left to the upper right), and an odd number of isolated fingers in each row. As illustrated, each row has four full fingers 138 and an end finger 134. Each of the two end rows 133 has the end finger 133 at the same end thereof (upper right as shown). The middle row 132 has its end finger 134 at the opposite end (lower left as shown). Each finger has a side surface 151 and a top surface 150. The space between adjacent fingers, either longitudinally or transversely, is the same dimension as the adjacent fingers. It is therefore apparent that if another identical connector to that illustrated in FIG. 17 is provided, turned upside down with respect to the shown figure, with its middle row end FIG. 134 toward the upper right, it may be mated with the shown connector, by moving it relatively axially with respect to the extended axes of the fingers, so as to form a complete connection.

In this embodiment, there is only mode of insertion and removal, that is, axially as has been described. The connectors are intrinsically held in a stable relationship in the horizontal plane. For illustrative purposes, this connector is shown as a array or multiplicity of coax conductors, each one having a center core connector 140, an insulating layer around it 141, and an outer conductive layer or shell or shield 142. As shown, each full finger 138 has two half coax conductors, facing in opposite directions, and the end fingers 134 have a single inwardly-facing coax conductor. It is apparent that these could be tri-axial conductors or even a higher number of multi-axial conductors.

There is a gap or space 143 between the fingers of adjacent rows. Preferably, the bottom portion of each of these gaps 143 is provided with a stop 135. The stop permits a measured control of the relative insertion of two connectors.

In connection with the embodiment of FIG. 9, there has been discussed the preferred provision of a taper or draft of the fingers so that their transverse dimension increases toward the base. Such a taper or draft, in effect making each finger a truncated pyramid, is a preferred expedient in the practical design of all the embodiments. Thus, the side walls are not parallel to each other when such taper is provided. The taper may be just several degrees from the vertical.

The term "identical" as used herein in referring to connectors means identical as to the mating or interfacing elements. It is apparent that parts of the connectors that are non-mating and are not an essential aspect of the thrust of this invention could be made non-identical without departing from the spirit of the invention. The invention has been described as having one half of a conductor in one mating finger and the other half in the other mating finger. It might be possible to design a connector in which the division of parts of the conductor is other than one half in each, but the concept of this invention would still be maintained and a more comprehensive description would be that part of the conductor is in one finger and the remaining part is in the mating adjacent finger.

One of the features or characteristics of this invention is that the structures and arrays as described and illustrated can be multiplied in their size and complexity without departing from the spirit or teachings of the invention. That is, a connector that is shown with, for example, four connectors, can be instead made with a much larger number of connectors. Alternatively, individual connectors can be ganged or stacked, side by side and above and below each other to increase the size of the overall array. Thus, there is a large degree of design and application flexibility inherent in this development. A stop may be preferable in some constructions, but the existence of the stop is not in itself essential to the operation of the invention.

If there are an odd numbers of rows, as shown in FIG. 17, the connection is fully polarized; it can only be assembled in one way. If there are an odd number of fingers in each row, as shown in FIG. 17, the mating connectors are hermaphroditic and identical. If there is not an odd number of fingers in each row, the mating connector would not be identical.

The conductive portions of all the connectors described herein can be made of known conductive plastic. For example, the embodiments of FIGS. 12 and 13 show a structure which lends itself to being constructed by having conductive plating on an underlying block of insulation.

Many of the multiple array embodiment of this invention lend themselves to field assembly, having push-in contacts. That is, individual elements of the connector can be individually assembled in the field, as for repair or replacement. If the fingers have all the elements (except the outer shell) individually insertable and removable into the array, such elements can be replaced in the field.

Multiple arrays, such as are shown in a number of the embodiments, can be combined side-by-side with other like connectors, in the field or during manufacture. That is, these connectors lend themselves to being ganged to make larger overall arrays. Such connectors may be provided with snap-on fastening to any known type, or they can be held in larger ganged assemblies in any other known way, as by surrounding bands, clips, screwed-together flanges etc.

Some aspects may be summarized. All of the embodiments, as full mated connectors, can be considered conceptually as cut-apart blocks. The block may be rectilinear or tubular. The block of course does not have to be physically cut-apart but its conception is as if it were. All of the connectors provide for multiple conductors.

Another common aspect is that the connectors of this invention provide for very restricted lateral or transverse dimensions. Thus, the connectors are transversely or laterally compact as the electrical or electronic requirements permit.

Another common characteristic is that all the mating conductor and mechanical elements are axially aligned, and all connection and disconnection may be made by axial sliding. No rotation or lateral movement is required.

We claim:

1. An electrical connection comprising a pair of identical hermaphroditic connectors, each said connector comprising a shell, a wiring face, at least two fingers, a space between said fingers, a said finger on one connector fitting into a space between said fingers on said other connector, at least one insulated conductor passing axially through said connector, equal portions of each insulated conductor extending longitudinally along each of said fingers, and each conductor being exposed the axial length of said finger, and each said conductor being exposed from the insulation along the axial length of each of said fingers to form an area for mating with the other connector of said pair and each said conductor being only partially circumferentially exposed from said insulation along the axial length of each of said fingers.

2. A connection as set forth in claim 1 wherein each said connector has at least two said axially extended fingers, and associated exposed conductors, each finger being separated from an opposed finger by a slot.

3. A connection as set forth in claim 2 wherein each said finger in each said connector has a tip remote from said wiring face and each said finger terminates in a bottom, a stop in each said slot, said slot extending from said bottom into said slot, whereby the mutual travel of said connector pair is limited.

4. An electrical connection comprising a pair of identical hermaphroditic connectors, each said connector comprising a shell, a wiring face, at least one finger, at least one insulated conductor passing axially through said connector, equal portions of each insulated conductor extending longitudinally along each of said fingers, each conductor being exposed the axial length of each said finger wherein each said connector has at least two axially extended fingers, each finger being separated from an opposed finger by a slot wherein each said finger has a tip remote from said wiring face and each said finger terminates in a bottom, and said slot terminates in a stop before reaching said bottom, wherein said connector is a co-axial connector, and said shell is made of conducting material, and one of said conductors is a central core.

5. A connection as set forth in claim 4 wherein the space between each adjacent finger is the same in both size and configuration, as the size and configuration of each finger, whereby any finger on one connector may be inserted firmly into any space on the other of said pair of connectors.

6. A connection as set forth in claim 5 wherein each of said fingers has an inner end face, a shoulder is provided at the base of said fingers near said bottom, and each said inner end face is configured and sized to match each said shoulder.

7. A connection as set forth in claim 6 wherein each said finger has a mild interference fit with each said space between said fingers.

8. A connection as set forth in claim 7 wherein there are two symmetrical and radially opposed fingers on each said connector, and the said inner end face of each finger is angled rearwardly from said tip of each said finger.

9. An electrical connection comprising a pair of identical hermaphroditic connectors, each said connector comprising a shell, a wiring face, at least one finger, at least one insulated conductor passing axially through said connector, equal portions of each insulated conductor extending longitudinally along each of said fingers, each conductor being exposed the axial length of said finger wherein each of said connectors contains a plurality of co-axial conductors, each said conductor being radially surrounded by an insulating layer, said shell being made of conducting material, and each said conductor comprises an alternating sequence of linearly spaced fingers and spaces to form a comb-like appearance, and each said co-axial conductor and its associated insulating layer is longitudinally equally split with one half of said conductor being along the length of each said finger and one half of each said conductor terminating at the bottom of the space between adjacent fingers.

10. A connection as set forth in claim 9 wherein there is at least one end finger and at least one interior finger, each said interior finger being provided with a slot, each of said interior fingers including at least one pair of longitudinally split co-axial conductors and insulating layers, the members of each said pair being disposed on opposite sides of said slot.

11. A connection as set forth in claim 1 wherein each of said connectors contains a plurality of co-axial conductors, each said conductor being surrounded by a layer of insulation and each said conductor comprises an alternating sequence of linearly spaced fingers and spaces to form a comb-like appearance, and each said co-axial conductor is longitudinally equally split with one half of said conductor being along the length of said finger and one half of said conductor terminating at the bottom of the space between adjacent fingers.

12. A connection as set forth in claim 11 wherein there is at least one end finger and at least one interior finger, each said interior finger being provided with a slot, each of said interior fingers including at least one pair of longitudinally split conductors, the members of each said pair being disposed on opposite sides of said slot.

13. A connection as set forth in claim 3 wherein said connector has a square equal sided inner surface, and there are only two said fingers, each finger comprising the area from an edge of said connector to the center of said connector and between diagonals running from the ends of said edge to said center.

14. A connection as set forth in claim 13 wherein there are a plurality of co-axial conductors and insulating layers and said shell is made of conducting material.

15. A connection as set forth in claim 14 wherein there is a slot between said fingers and the space between each finger has a bottom, and said slot terminates in a stop before reaching said bottom.

16. A connection as set forth in claim 15 wherein there are a plurality of conductors and said shell is made of insulating material.

17. A connection as set forth in claim 16 wherein there is a slot between said fingers and the space between each finger has a bottom, and said slot terminates in a stop before reaching said bottom.

* * * * *